US006227456B1

(12) United States Patent
Colman

(10) Patent No.: US 6,227,456 B1
(45) Date of Patent: May 8, 2001

(54) WATER DELIVERY SYSTEM WITH MULTIPLE HEAD CAPABILITY

(76) Inventor: Peter Ingalls Colman, 4301-32nd St., West, unit C-11, Bradenton, FL (US) 34205

( * ) Notice: Subject to any disclaimer, the term of this patent is extended or adjusted under 35 U.S.C. 154(b) by 0 days.

(21) Appl. No.: 09/512,096

(22) Filed: Feb. 24, 2000

Related U.S. Application Data

(60) Provisional application No. 60/121,356, filed on Feb. 24, 1999.

(51) Int. Cl.[7] ..... B05B 17/00

(52) U.S. Cl. ..... 239/1; 239/536; 239/550; 239/562; 4/601; 4/615

(58) Field of Search ..... 239/1, 536, 548, 239/550, 551, 552, 554, 556, 557, 562, 566, 567, 569; 4/601, 615, 567, 568, 570; 138/177, 178, DIG. 11; 137/561 A, 883

(56) References Cited

U.S. PATENT DOCUMENTS

| | | | | |
|---|---|---|---|---|
| 1,516,226 | * | 11/1924 | Wixom | 239/550 |
| 1,544,706 | * | 7/1925 | Wallen | 239/550 |
| 3,913,839 | * | 10/1975 | Wilson | 239/551 |
| 4,752,975 | * | 6/1988 | Yates | 4/601 |
| 5,564,139 | * | 10/1996 | Shorr | 4/601 |

* cited by examiner

*Primary Examiner*—Lisa Ann Douglas
(74) *Attorney, Agent, or Firm*—Dorothy S. Morse

(57) ABSTRACT

A water delivery system for shower stalls that divides water delivered from one outflow alternatively into two, three, four, five, and six water streams. The system comprises an elongated larger water delivery member having two approximately parallel showerhead attachment arms with two 90° angles and one approximately 145° angle between them. The system also comprises a shorter water delivery member having two approximately parallel showerhead attachment arms with two 90° angles between them, and an optional third showerhead connector. The 145° angle in the larger water delivery member allows ample ceiling clearance for the system when the larger member is rotated for its installation and removal from water delivery pipes positioned at heights commonly used for human shower applications. Also, the female connection on the shorter water delivery member of the system has a sufficiently extended threaded connection to allow the shorter water delivery member to be rotated 90 degrees from a horizontal to a vertical orientation where the uppermost showerhead could be used to wash one's hair while the lower showerhead could remain directed toward the user's body. In the horizontal position, two people could simultaneously shower in the same shower stall and each have a water stream directed exclusively toward them. Any type of showerhead could be attached to the ends of the larger and smaller water delivery members, including hand-held showerheads. Applications, although not limited to such use, could include such diversity as routine personal hygiene to the rinsing of people exposed to hazardous materials.

20 Claims, 15 Drawing Sheets

WATER DELIVERY SYSTEM WITH MULTIPLE HEAD CAPABILITY

The invention herein was disclosed in U.S. provisional patent application No. 60/121,356, entitled Water Delivery System With Multiple Head Capacity and filed on Feb. 24, 1999, by its sole inventor, Peter I. Colman, the filing date of Feb. 24, 1999, being claimed herein as a priority date for the present invention.

BACKGROUND

1. Field of Invention

The present invention relates to water delivery systems, specifically to a water delivery system for shower stalls that divides water delivered from one outflow alternatively into two, three, four, five, and six water streams. The system would comprise an elongated larger water delivery member having two approximately parallel showerhead attachment arms with two 90° angles and one approximately 145° angle between them. The system would also comprise a shorter water delivery member having two approximately parallel showerhead attachment arms with two approximately 90° angles between them. Each could be used separately, or in combination. The 145° angle in the larger water delivery member allows ample ceiling clearance for the system when the larger member is rotated for its installation and removal from water delivery pipes positioned at heights commonly used for human shower applications. Also, the female connection on the shorter water delivery member of the system would have a sufficiently extended threaded connection to allow the shorter water delivery member to be rotated 90° from a horizontal to a vertical orientation without leaking where a showerhead connected to the uppermost arm could be used to wash one's hair while a showerhead connected to the lower arm could remain directed toward the user's body. In the horizontal position, two people could simultaneously shower in the same shower stall and each have a water stream directed exclusively toward their use. The same or different types of showerheads could be attached to the ends of the larger and smaller water delivery members, including hand-held showerheads. Applications, although not limited to such use, could include such diversity as routine personal hygiene to the rinsing of people exposed to hazardous materials.

2. Description of Prior Art

A single showerhead is sometimes insufficient to deliver ample water over a wide surface area on a person's body to give that person a satisfying shower experience. Dual showerheads are known and offer a person needing to be rinsed more water flow and faster rinsing. However, the capability of the present invention to offer varying combinations of two, three, four, five, and six showerheads, gives users even more flexibility in achieving a shower experience ideal for them. Larger people in both height and girth would be able to adjust two, three, four, five, and six water sprays in varying degrees of overlap to achieve the ideal combination of concentrated water flow and rinsed surface area. Also, the present invention is distinguished from other dual or multiple showerhead water delivery systems in that its smaller water delivery member has closely spaced apart showerheads which can easily be directly in a 360° rotation and can be pointed away from one another for two people to shower in the same shower stall, with each person becoming rinsed faster than otherwise would be possible. If two smaller water delivery members were attached to the larger one, each person could have his or her own independent water sprays directed toward the body, with a second available for rinsing hair, and optionally a third water spray from a hand-held showerhead to provide more precisely directed rinsing. During use for rinsing people exposed to hazardous materials, the greater amount of water delivered by the present invention, as well as the greater surface area covered at one time, has an important advantage. There is no known invention having all of the advantages of the present invention.

SUMMARY OF INVENTION—OBJECTS AND ADVANTAGES

It is the primary object of this invention to provide a multiple-piece water delivery system for the attachment of two, three, four, five, or six showerheads that furnishes greater water flow for faster rinsing. It is also an object of this invention to provide a water delivery system for the attachment of showerheads which can be made divergent to allow two persons to shower in the same stall together. A further object of this invention is to provide a water delivery system with an elongated larger member which incorporates a 145° angle between showerhead connection arms to accommodate the rotation of the larger water delivery member during installation and removal. It is also an object of this invention to provide a water delivery system for the attachment of showerheads in which the shorter water delivery member has sufficiently deep threads so that it may be horizontally or vertically positioned without leaking. It is also an object of this invention to provide a water delivery system for the attachment of showerheads that is cost effective and aesthetically pleasing in design for widespread manufacture and use.

As described herein, properly manufactured and connected to a positive pressure water delivery pipe, the present invention would provide a water delivery system for shower stalls which divides water delivered from one outflow into either two, three, four, five, or six water streams. The system would comprise an elongated larger water delivery member having two approximately parallel showerhead attachment arms with two 90° angles and one approximately 145° angle between them. The system would also comprise a shorter water delivery member having two approximately parallel showerhead attachment arms with two approximately 90° angles between them. Each could be used separately, or in combination with the other. Each arm could also have a water cutoff valve for restricting or eliminating water flow from one or more showerhead for special purposes. The 145° angle in the larger water delivery member allows ample ceiling clearance for the system when the larger member is rotated for its installation and removal from water delivery pipes positioned at heights commonly used for human shower applications. Also, the female connection on the shorter water delivery member of the system would have a sufficiently extended threaded connection to allow the shorter water delivery member to be rotated 90° from a horizontal to a vertical orientation without leaking where a showerhead connected to the uppermost arm could be used to wash one's hair while a showerhead connected to the lower arm could remain directed toward the user's body. Such a connection could also be made into a pivot point. In the horizontal position, two people could simultaneously shower in the same shower stall and each have a water stream directed exclusively toward their use. The same or different types of showerheads could be attached to the ends of the larger and smaller water delivery members, including hand-held showerheads. Optionally, each smaller water delivery member could include a third showerhead connection to add a third water spray from a hand-held showerhead that would provide even more precisely targeted rinsing. Applications, although not limited to such use, could include such diversity as routine personal hygiene to the rinsing of people exposed to hazardous materials. The capability of the present invention to offer varying combinations of two, three, four, five, and six showerheads, gives users even more flexibility in achieving a shower experience ideal for them. Larger people in both height and girth would be able to adjust two, three, four, five, or six water sprays in varying degrees of overlap to achieve the ideal combination of concentrated water flow and rinsed surface area. Also, the present invention is distinguished from other dual or multiple showerhead water delivery systems in that its smaller water delivery member has closely spaced-apart showerheads, approximately three inches in the preferred embodiment, which can easily be directly in a 360° rotation and can be pointed away from one another for two people to shower in the same shower stall, with each person becoming rinsed faster than otherwise would be possible. If two smaller water delivery members were attached to the larger one, each person could have his or her own independent water sprays directed toward the body, with a second available for rinsing hair, and optionally a third water spray from a hand-held showerhead to provide more precisely directed rinsing. During use for rinsing people exposed to hazardous materials, the greater amount of water delivered by the present invention, as well as the greater surface area covered at one time, has an important advantage.

The description herein provides preferred embodiments of the present invention but should not be construed as limiting the scope of the water delivery invention. For example, variations in the depth of the male threads on the showerhead attachment arms of both the large and small water delivery members, the orientation of the smaller water delivery member during use, and the use of one or more water cutoff valves, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
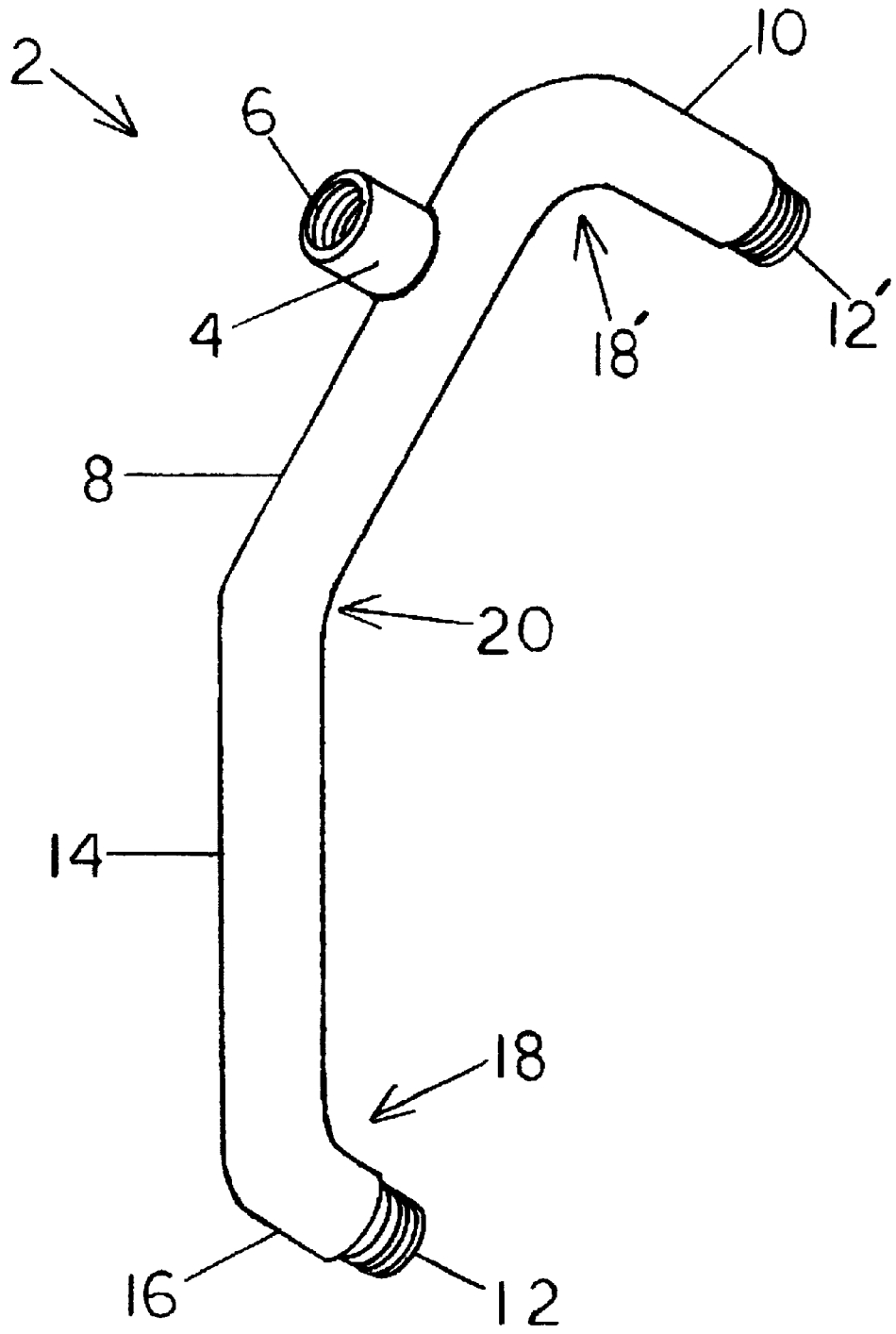
FIG. 1 is a perspective view of a first embodiment of the elongated larger water delivery member of the present invention.

FIG. 1 shows a first preferred embodiment of the elongated larger water delivery member 2 of the present invention. Two approximately parallel arms 10 and 16 each have a distal end with an externally threaded male connection, numbered 12' and 12 respectively. Arms 10 and 16 are separated by first cross member 8 and second cross member 14. Although FIG. 1 shows first cross member 8 being slightly shorter in length than second cross member 14, the length of each is not critical and it is also considered within the scope of the present invention for second cross member 14 to be shorter than first cross member 8, as well as for both cross members to have identical length dimensions. The angle 18' between arm 10 and adjacent first cross member 8 is approximately 90° and permits water flowing into arm 10 to be diverted at an approximate 90° angle relative to first cross member 8. The angle 20 between cross members 8 and 14 is approximately 145° so that as larger water delivery member 2 is rotated for installation and removal from an existing water delivery pipe, shown in FIG. 2 as number 24, arm 16 will not come into contact with the ceiling above the shower stall, the ceiling being represented by the number 50 in FIG. 2. The angle 18 between arm 16 and adjacent cross member 14 is slightly larger than 90° and of a dimension that permits water flowing into arm 16 to be diverted at an approximate 90° angle relative to first cross member 8. Close to arm 10 and connected through the surface of cross member 8 in a position opposed to arm 10, FIG. 1 shows a short outflow connector 4 with internal threads 6 adapted for connection to external threads (not shown) on water delivery pipe 24. It is contemplated for larger water delivery member 2 to be made from any plastic or metal material commonly used for water delivery purposes, such as PVC, ABS plastic, stainless steel, brass with chrome plating, or copper. Also, it is contemplated for larger water delivery member 2 to be gold-plated, or to be covered with materials suitable for water delivery purposes having any color, texture, or design. Although larger water delivery system 2 could be used in any orientation, in the first preferred embodiment larger water deliver member 2 would be used with arm 10 in a position above arm 16. Also, although larger water deliver members 2 could be made from larger diameter materials, for use in connection to the existing standard size of water delivery pipe in shower stalls, in the first preferred embodiment short outflow connector 4, arms 10 and 16, as well as cross members 8 and 14 would be made from tubing having an internal diameter of one-half inch.

Figure 2:
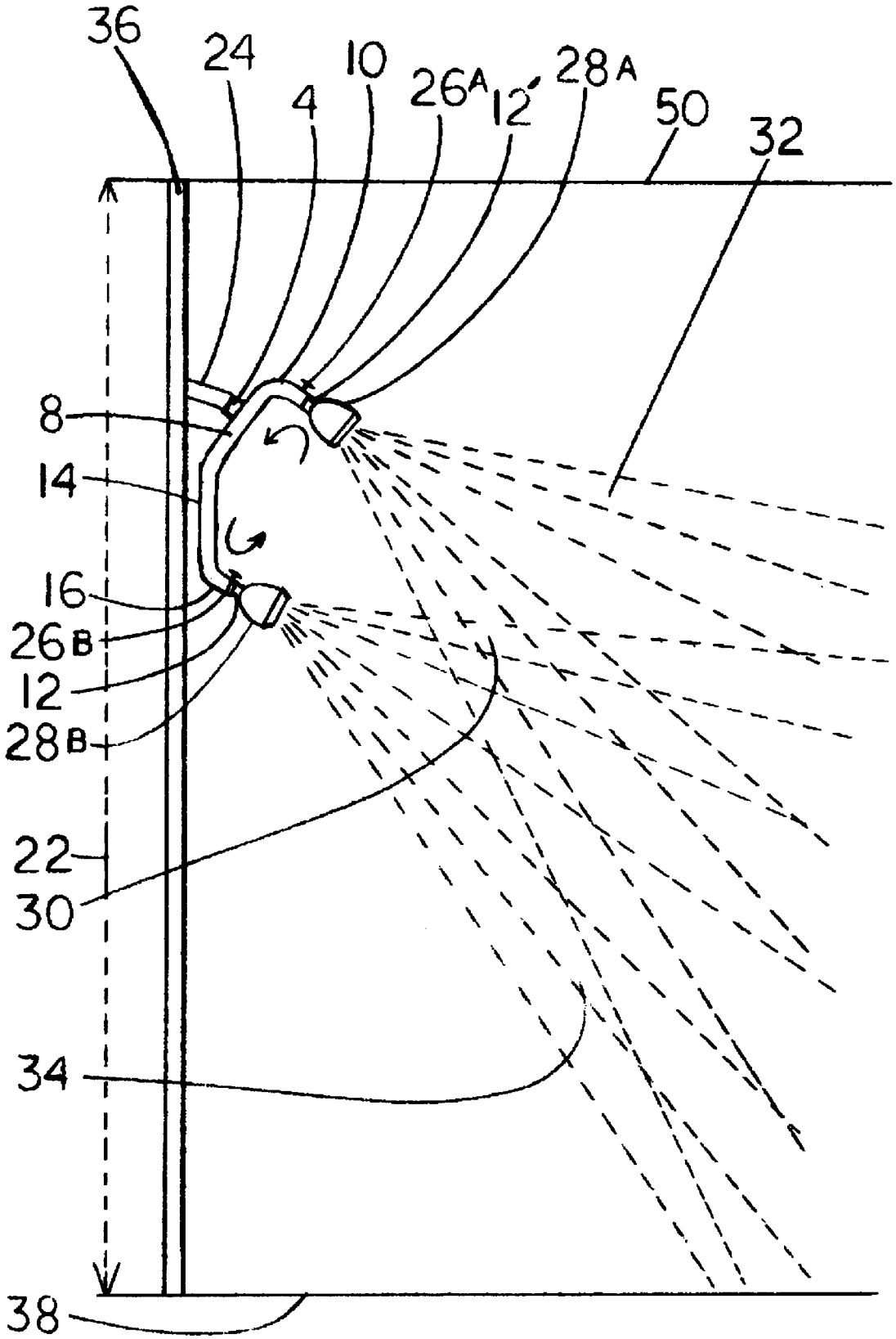
FIG. 2 is a side view of the first embodiment of the larger water delivery member attached to a water delivery pipe in a shower stall, with each arm having a water cutoff valve and showerheads similar in configuration attached thereto.
Figure 3:
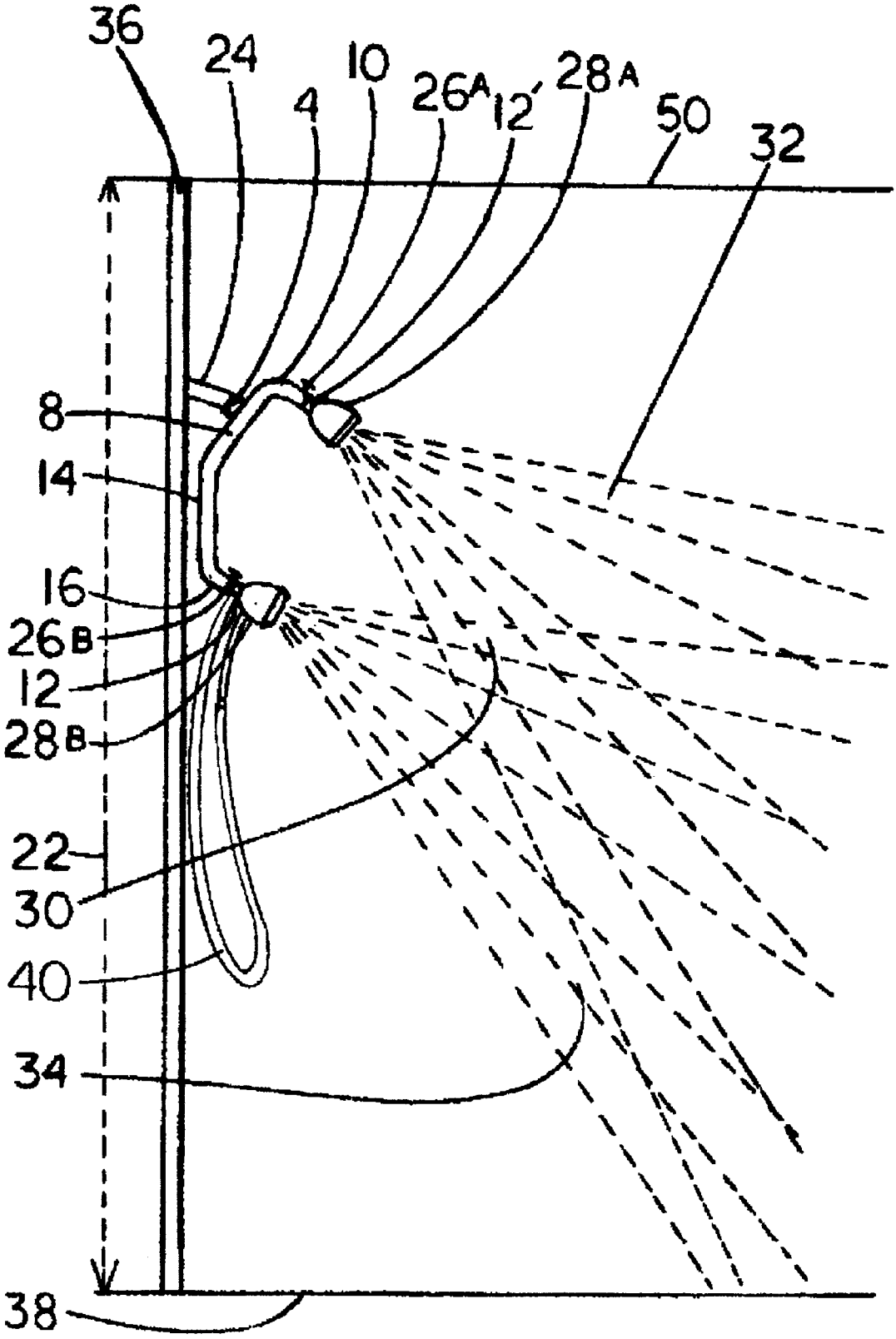
FIG. 3 is a side view of the first embodiment of the larger water delivery member attached to a water delivery pipe in a shower stall, with each arm having a water cutoff valve and two different types of showerheads attached thereto.

FIG. 2 shows the short outflow connector 4 of the first preferred embodiment of larger water delivery member 2 attached to water delivery pipe 24 in a shower stall defined by floor 38, ceiling 50, and wall 36. The vertical height of the shower stall is represented by number 22 and in modern construction is typically seventy-eight inches. Arm 10 has been placed in a position above arm 16, with first cross member 8 at an approximately 45° angle relative to wall 36 and second cross member 14 approximately parallel to wall 36. Arms 10 and 16 each have a water shut-off valve, **26*a* and 26*b* respectively, to allow water to be diverted from one or the other showerhead 28*a* or 28*b* upon demand. Although water shut-off valves 26*a* and 26*b* appear in FIG. 2 to have a rotatable configuration, such means for water shut-off is not critical and it is considered within the scope of the present invention to have other means for water shutoff, such as push buttons 56 and 56' shown in FIGS. 8–15. Showerhead 28*a* is attached to the male threaded connection 12' on arm 10, with showerhead 28*b* attached to the male threaded connection 12 on arm 16. FIG. 2 also shows the water spray 32 from showerhead 28*a* and the water spray 34 from showerhead 28*b* beginning to mix in the immediate area of the number 30. FIG. 3 is similar to FIG. 2, but also shows tubing 40 attached between showerhead 28*b* and threaded male connection 12 on arm 16. Although not illustrated in FIG. 3, showerhead 28*b* would be detachably connected to arm 16 so that showerhead 28*b*** can be used as a hand-held shower unit.

Figure 4:
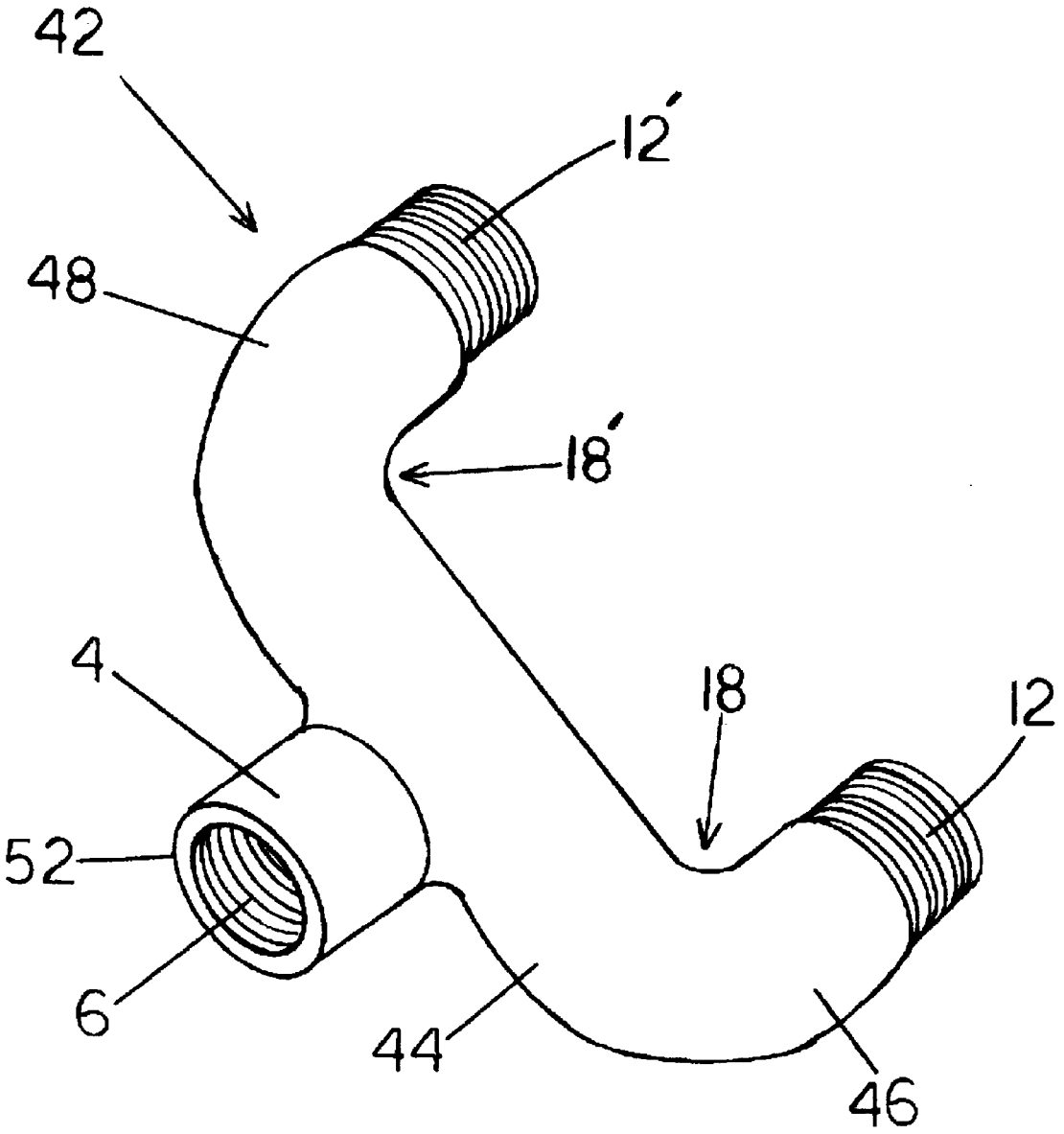
FIG. 4 is a perspective view of a first embodiment of the smaller water delivery member of the present invention.

FIG. 4 shows a first preferred embodiment of the smaller water delivery member 42 of the present invention. Two approximately parallel arms 48 and 46 each have a distal end with an externally threaded male connection, numbered 12' and 12 respectively. Arms 48 and 46 are separated by a single cross member 44. The angle 18' between arm 48 and cross member 44 is approximately 90°. The angle 18 between arm 46 and cross member 44 is also approximately 90°. Centrally between arm 48 and arm 46, and connected through the surface of cross member 44 in an opposed position from arms 48 and 46, FIG. 4 shows a short outflow connector 4 with internal threads 6 for connection to water delivery pipe 24. FIG. 4 also shows the upper edge of short outflow connector 4 being configured for use as a pivot point 52. It is contemplated for smaller water delivery member 42 to also be made from any plastic or metal material commonly used for water delivery purposes, such as PVC, ABS plastic, stainless steel, brass with chrome plating, or copper. Also, it is contemplated for smaller water delivery member 42 to be gold-plated, or to be covered with materials suitable for water delivery purposes having any color, texture, or design. However, when larger water delivery member 2 is used in combination with smaller water delivery member 42, in the first preferred embodiments both larger and smaller water delivery members 2 and 42 respectively would be made from the same materials. Although smaller water delivery member 42 could be used in any orientation, in the first preferred embodiment larger water deliver member 2 would be used with arm 10 in a position above arm 16. Although smaller water deliver member 2 could be made from larger diameter materials, for use in connection to the existing standard size of water delivery pipe in shower stalls, in the first preferred embodiment short outflow connector 4, arms 48 and 46, as well as cross member 44 would be made from tubing having an internal diameter of approximately one-half inch.

Figure 5:
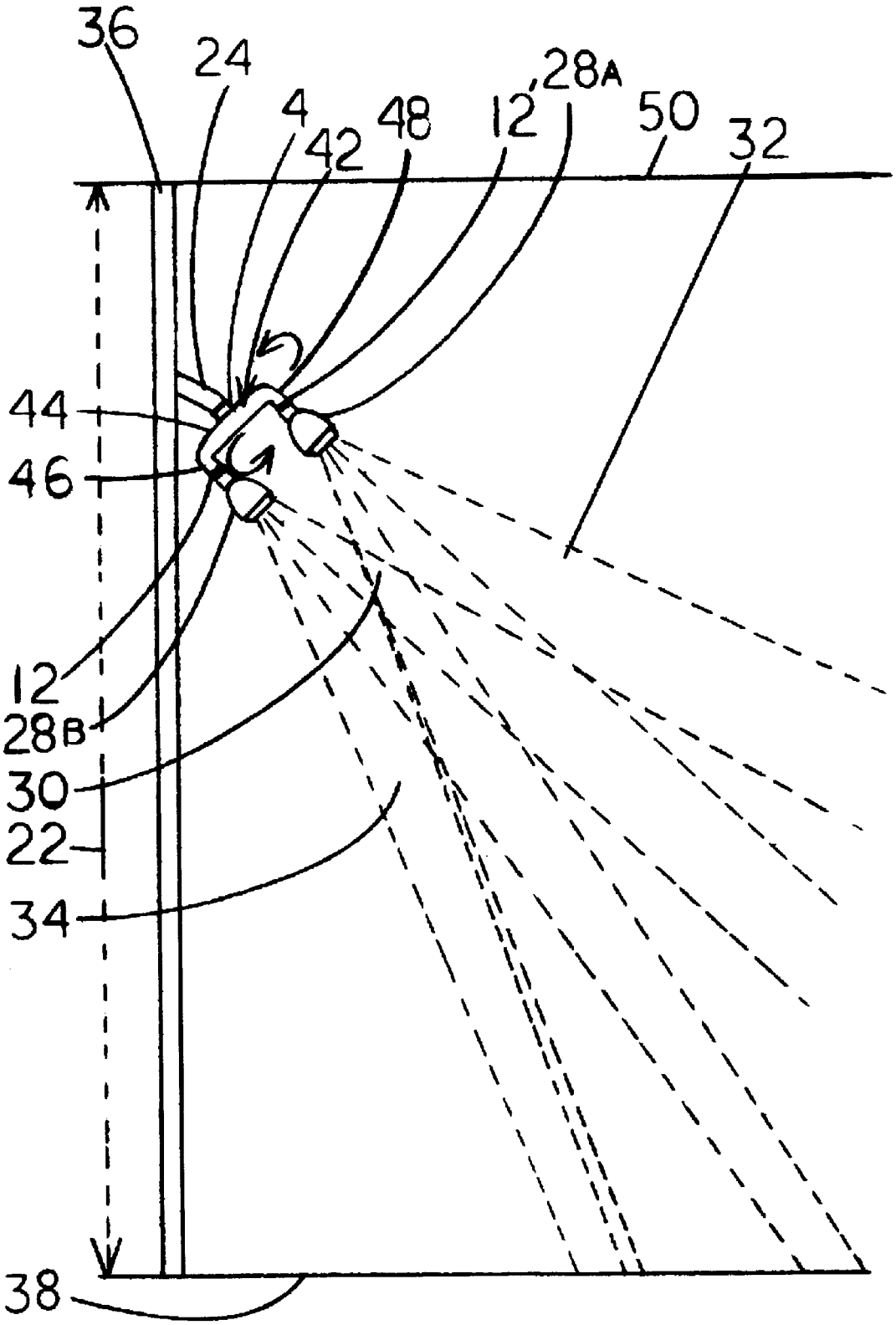
FIG. 5 is a side view of the first embodiment of the smaller water delivery member attached to a water delivery pipe in a shower stall, with each arm having a showerhead attached thereto and the arms in a vertical position relative to one another.

FIG. 5 shows the short outflow connector 4 of the first preferred embodiment of smaller water delivery member 42 attached to water delivery pipe 24 in a shower stall defined by floor 38, ceiling 50, and wall 36. The vertical height of the shower stall is represented by the number 22. Arm 48 has been placed in a position approximately vertical with arm 46, with cross member 44 at an approximately 45° angle relative to wall 36. Showerhead **28*a* is attached to the male threaded connection 12 on arm 48, with showerhead 28*b* attached to the male threaded connection 12 on arm 46. FIG. 5 also shows the water spray 32 from showerhead 28*a* and the water spray 34 from showerhead 28*b* beginning to mix approximately in the area of number 30. Arrows show that smaller water delivery member 42 can be rotated so that showerheads 28*a* and 28*b*** become positioned in alternative orientations.

Figure 6:
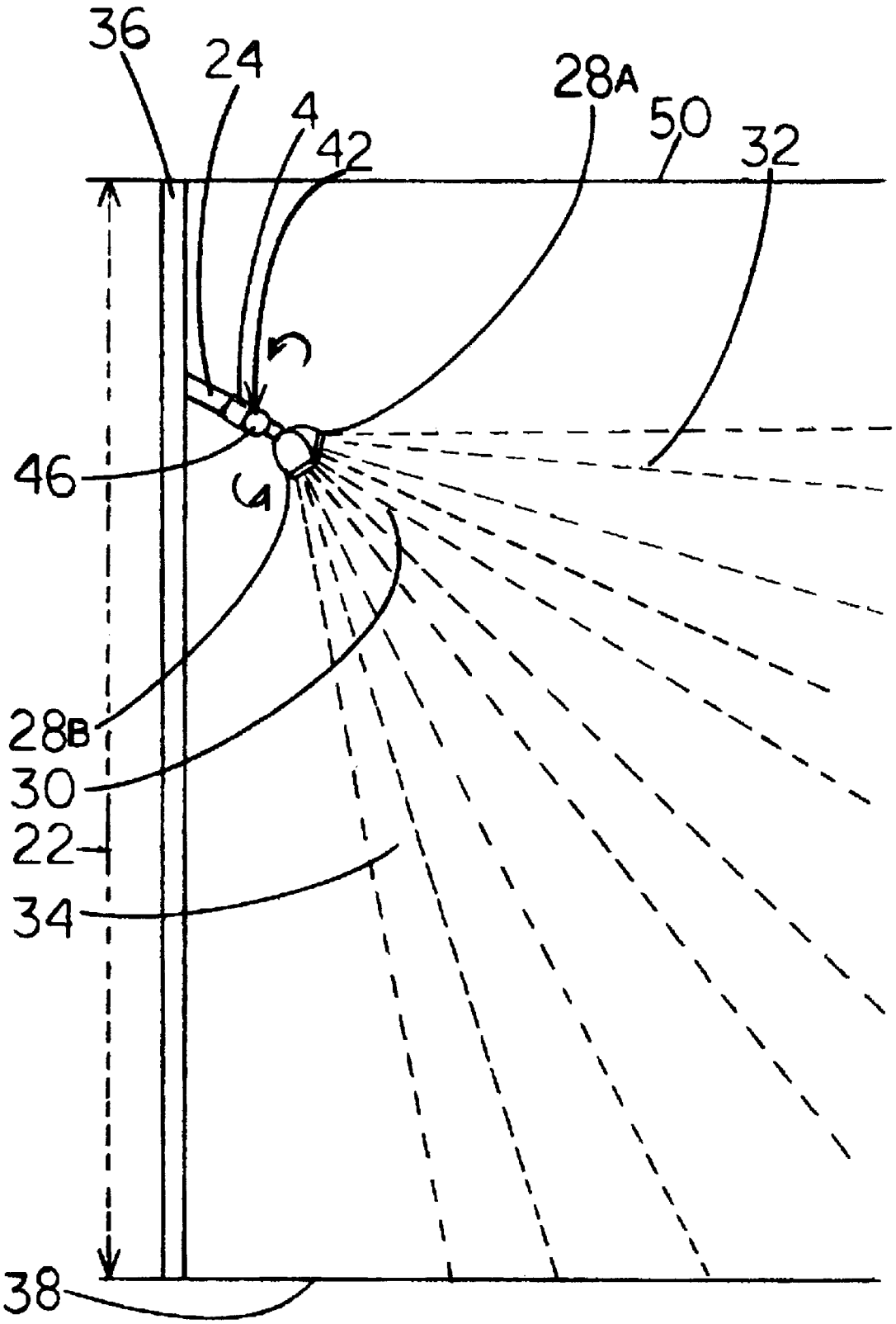
FIG. 6 is a side view of the first embodiment of the smaller water delivery member attached to a water delivery pipe in a shower stall, with each arm having a showerhead attached thereto and the arms in a horizontal position relative to one another.

FIG. 6 shows outflow connector 4 of the first preferred embodiment of smaller water delivery member 42 attached to water delivery pipe 24. FIG. 6 also shows showerhead 28*a* positioned behind showerhead 28*b* with arm 46 visible and arm 48 hidden from view since arm 46 is in a position approximately horizontal with arm 48. While not shown, cross member 44 is positioned at an approximately 45° angle relative to wall 36. Arrows show that smaller water delivery member 42 can be rotated so that showerheads 28*a* and 28*b* become placed into a variety of alternative orientations. FIG. 6 also shows a shower stall being defined by wall 36, ceiling 50, and floor 38, with the vertical height of the shower stall being represented by the number 22. FIG. 6 also shows water spray 32 projecting from showerhead 28*a*, water spray 34 projecting from showerhead 28*b*, and the water in both sprays 32 and 34 beginning to mix immediate to the 41 area around number 30.

Figure 7:
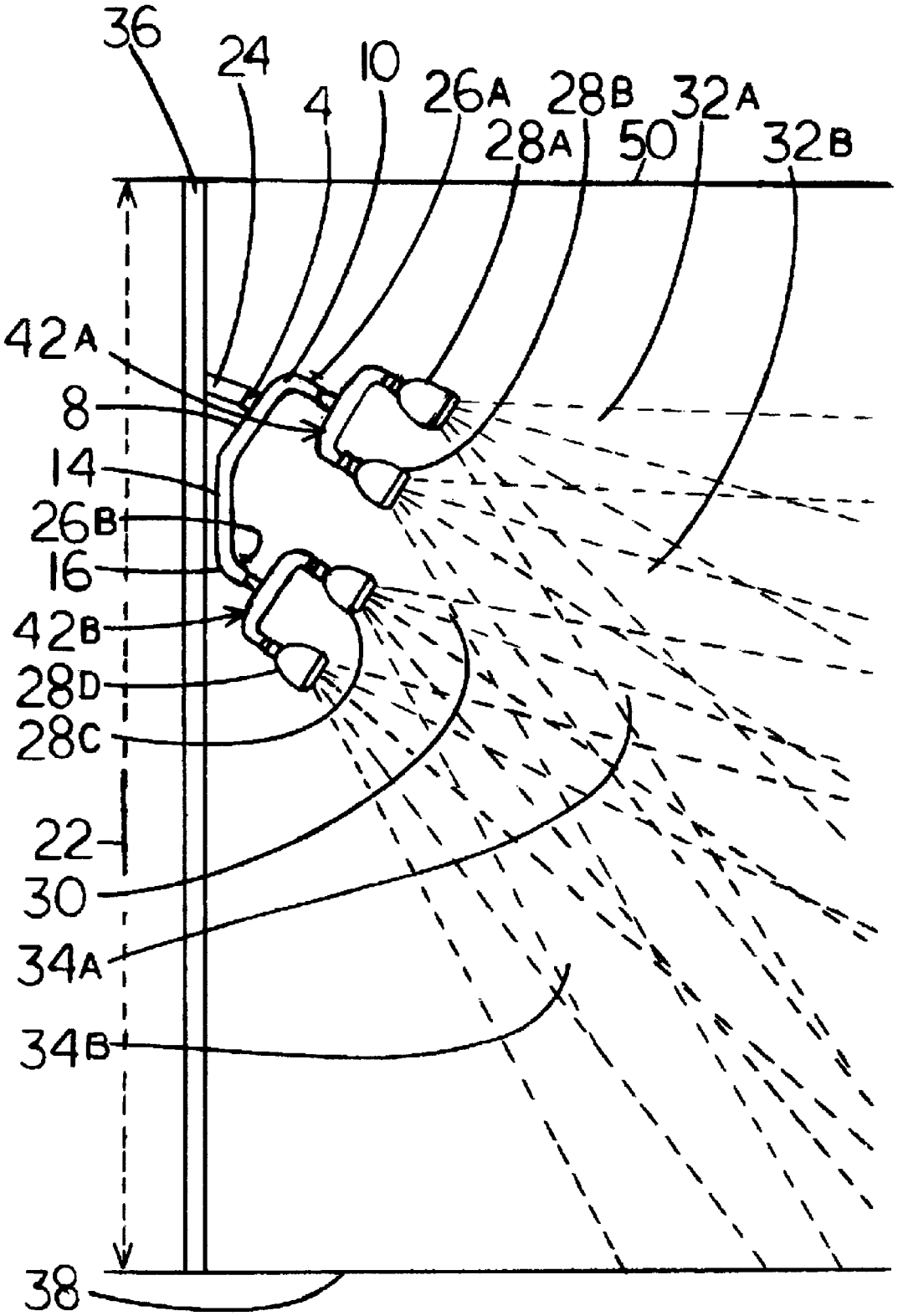
FIG. 7 is a side view of the first embodiments of both the larger water delivery member and the smaller water delivery member, with the larger water delivery member attached to a water delivery pipe in a shower stall, with each arm being in a vertical position relative to one another, with each arm having a water cutoff valve and a smaller water delivery member attached to each arm of the larger water delivery member and the arms of the smaller water delivery member also in a vertical position relative to one another.

FIG. 7 shows the short outflow connector 4 of first embodiment of larger water delivery member 2 attached to water delivery pipe 24 in a shower stall defined by floor 38, ceiling 50, and wall 36. The vertical height of the shower stall is represented by number 22. Arm 10 has been placed in a position above arm 16, with cross member 8 at an approximately 45° angle relative to wall 36 and cross member 14 approximately parallel to wall 36. Arms 10 and 16 each have a water shut-off valve, 26*a* and 26*b* respectively, to allow water to be diverted from one or the other of the first preferred embodiments of smaller water delivery members 42 upon demand. FIG. 7 further shows smaller water delivery member 42*a* connected to arm 10 and smaller water delivery member 42*b* connected to arm 16. FIG. 7 also shows smaller water delivery member 42*a* with showerheads 28*a* and 28*b* positioned with showerhead 28*a* above showerhead 28*b*, and smaller water delivery member 42*b* with showerheads 28*c* and 28*d* positioned with showerhead 28*c* above showerhead 28*d*. FIG. 7 further shows the water spray 32*a* and 32*b* from showerheads 28*a* and 28*b* respectively, and the water spray 34*a* and 34*b* from showerheads 28*c* and 28*d* beginning to mix in the immediate area around three positions indicated by 30.

Figure 8:
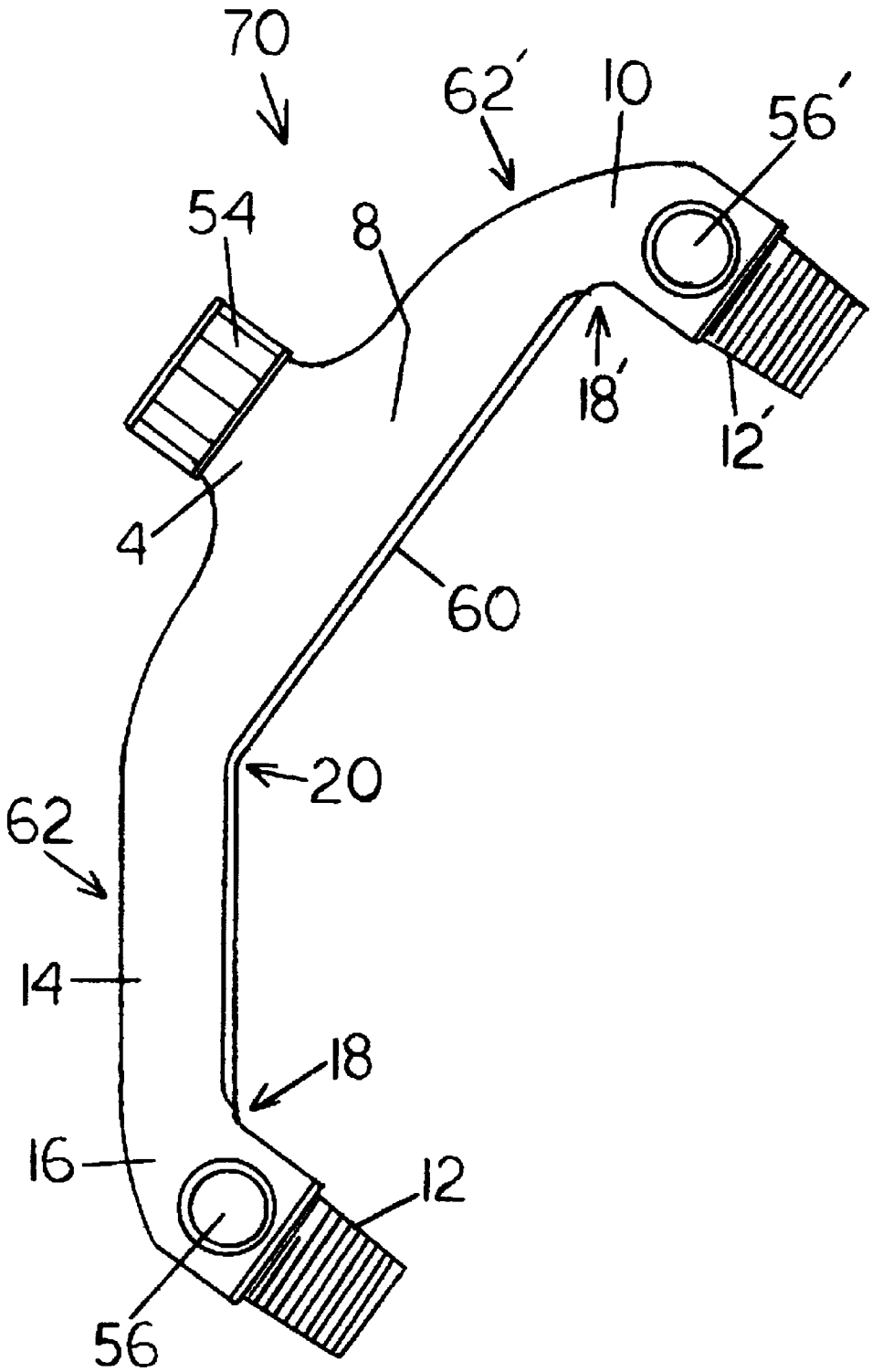
FIG. 8 is a side view of a second embodiment of the elongated larger water delivery member of the present invention with a threaded swivel adaptor attached to the outflow connector and pushbutton controls for selective water cut-off.
Figure 9:
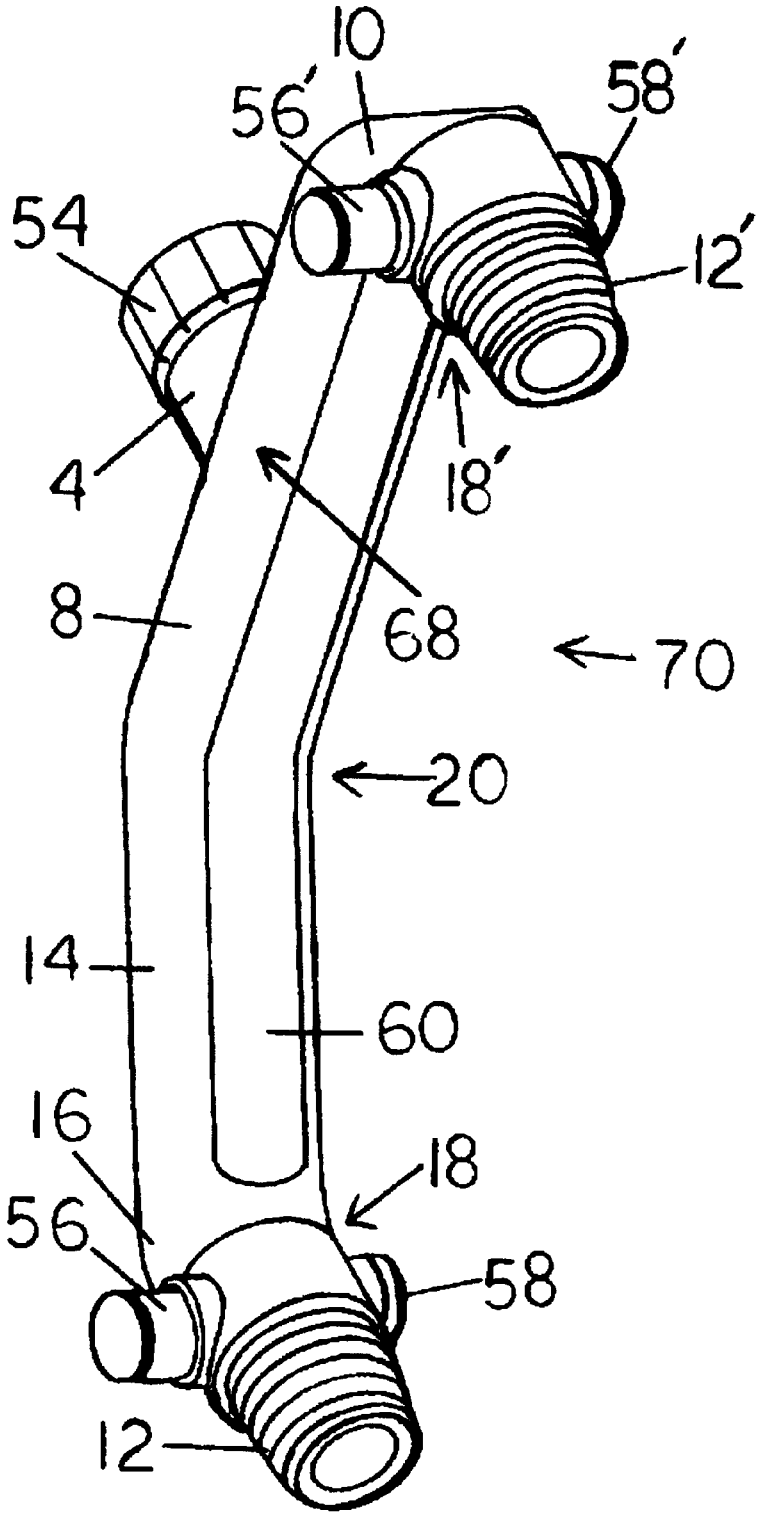
FIG. 9 is a perspective bottom view of the second embodiment of the larger water delivery member having a threaded swivel adaptor attached to the outflow connector, barrel valves each having a push-button control for selective water cut-off, and a flattened lower surface.
Figure 10:
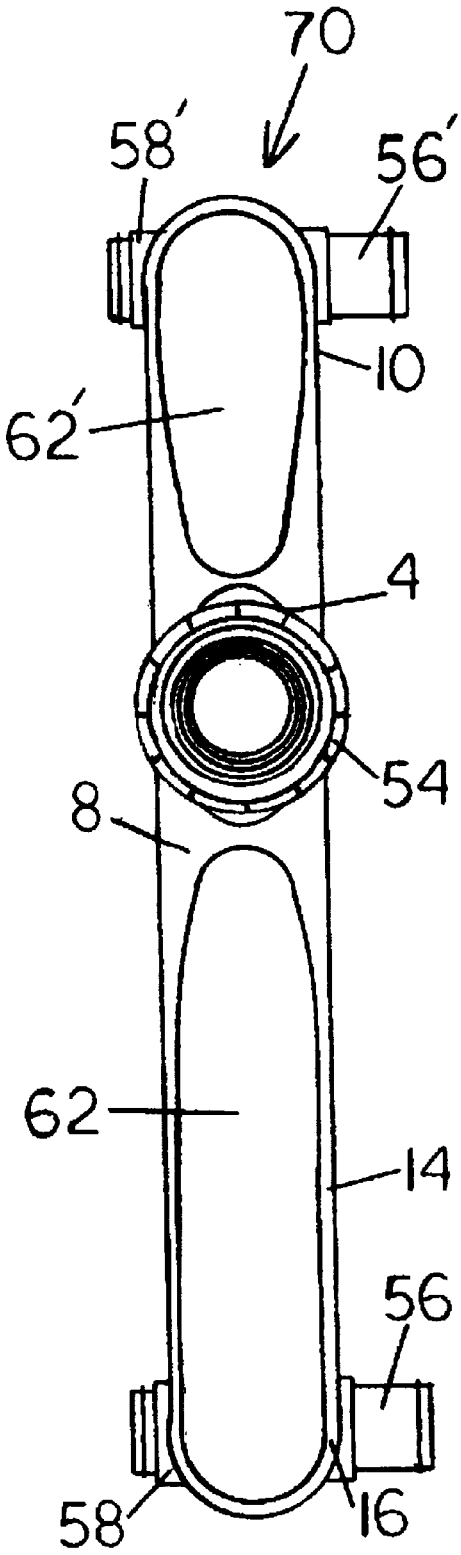
FIG. 10 is a top view of the second embodiment of the larger water delivery member having a threaded swivel adaptor attached to the outflow connector, barrel valves each with a push-button control for selective water cut-off, and a flattened upper surface.
Figure 11:
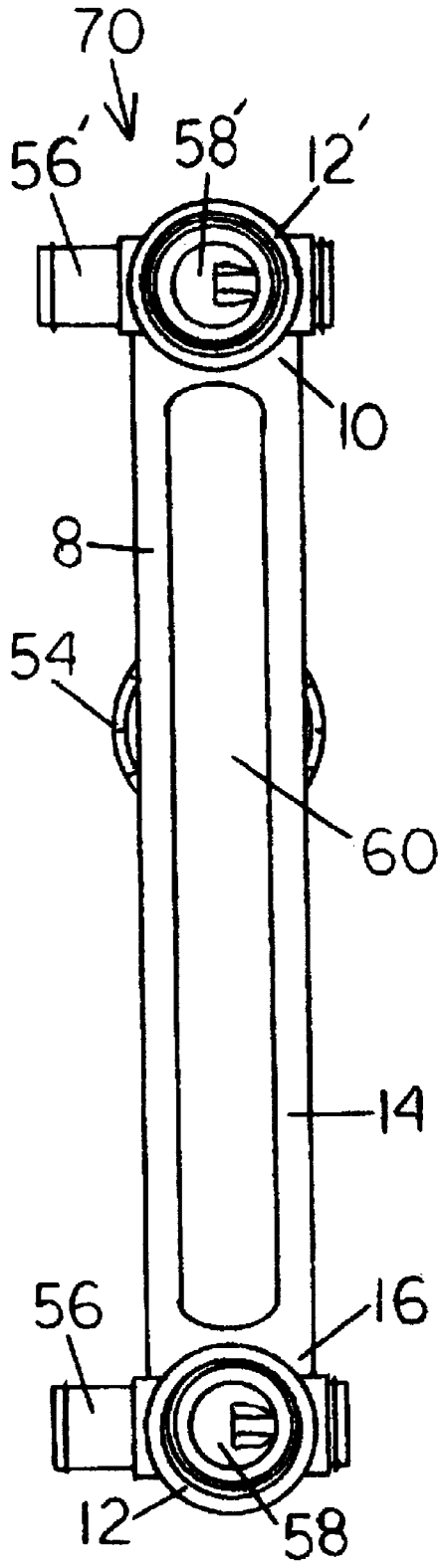
FIG. 11 is a bottom view of the second embodiment of the larger water delivery member having a threaded swivel adaptor attached to the outflow connector, a flattened lower surface, and barrel valves each with a push-button control for selective water cut-off and shown in an opened configuration.
Figure 12:
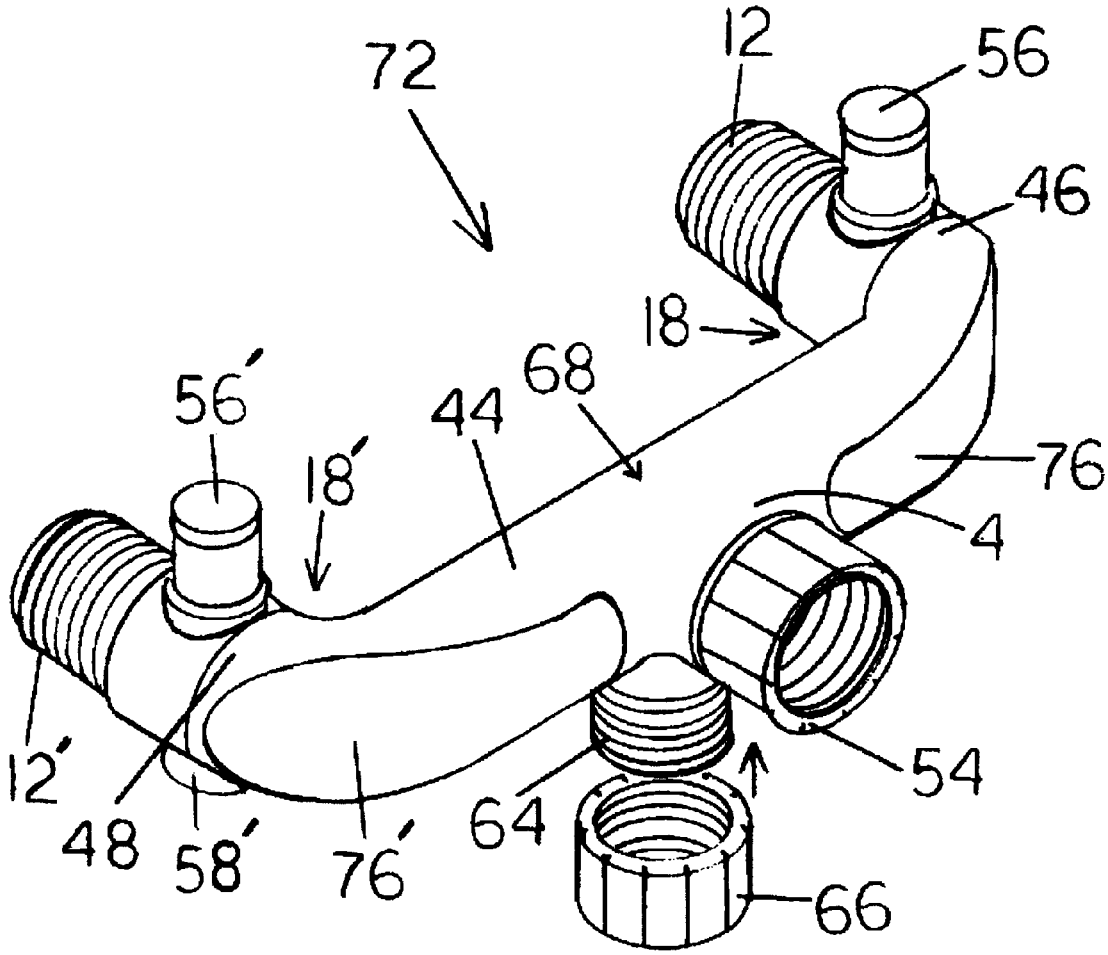
FIG. 12 is a perspective view of a second embodiment of the smaller water delivery member of the present invention having a threaded swivel adaptor attached to the outflow connector, the outflow connector having an aesthetically pleasing artistic design, barrel valves each with a push-button control for selective water cut-off, a third male connection with a threaded cap, and a flattened upper surface.
Figure 13:
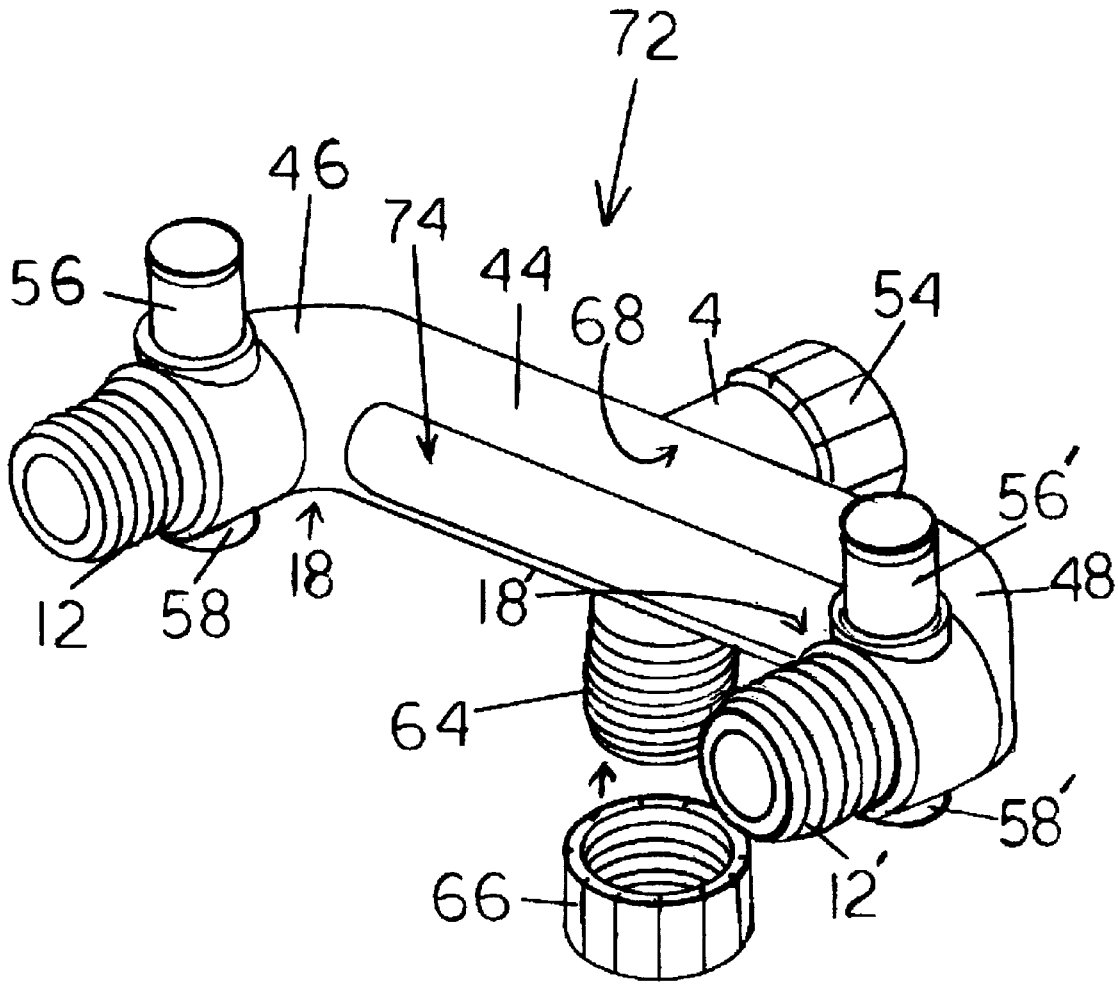
FIG. 13 is a lower perspective view of the second embodiment of the smaller water delivery member having a threaded swivel adaptor attached to the outflow connector, barrel valves each with a push-button control for selective water cut-off, a third male connection with a threaded cap, and a flattened lower surface.
Figure 14:
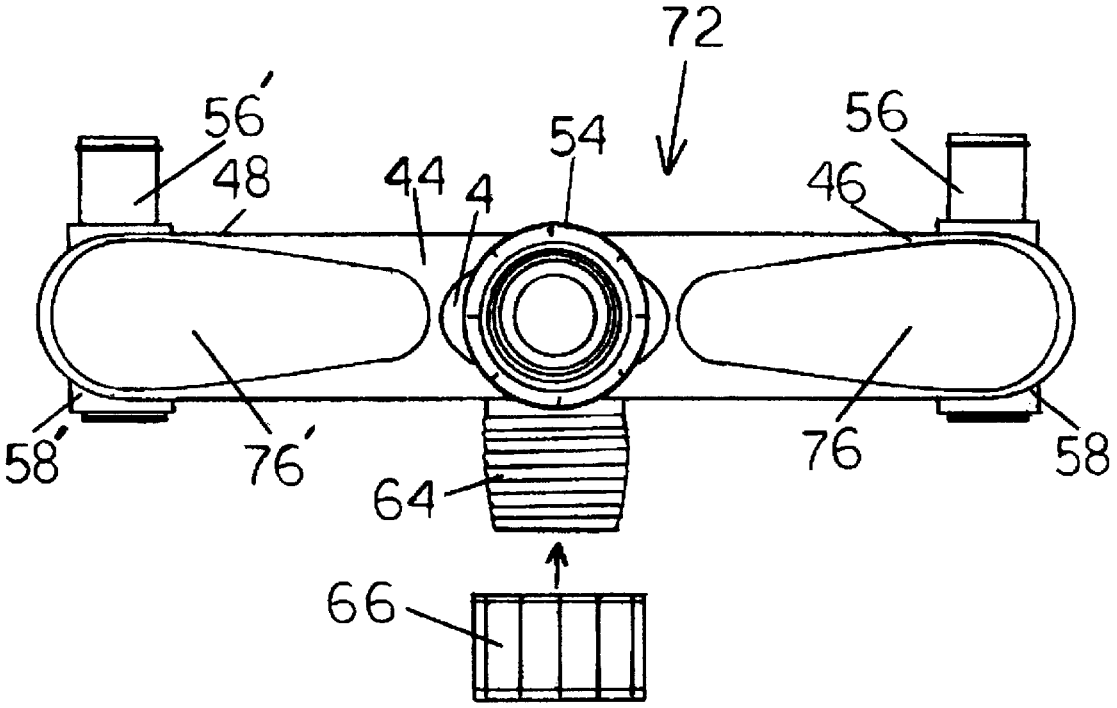
FIG. 14 is a top view of the second embodiment of the smaller water delivery member having a threaded swivel adaptor attached to the outflow connector, barrel valves each with a push-button control for selective water cut-off, a third male connection with a threaded cap, and a flattened upper surface.
Figure 15:
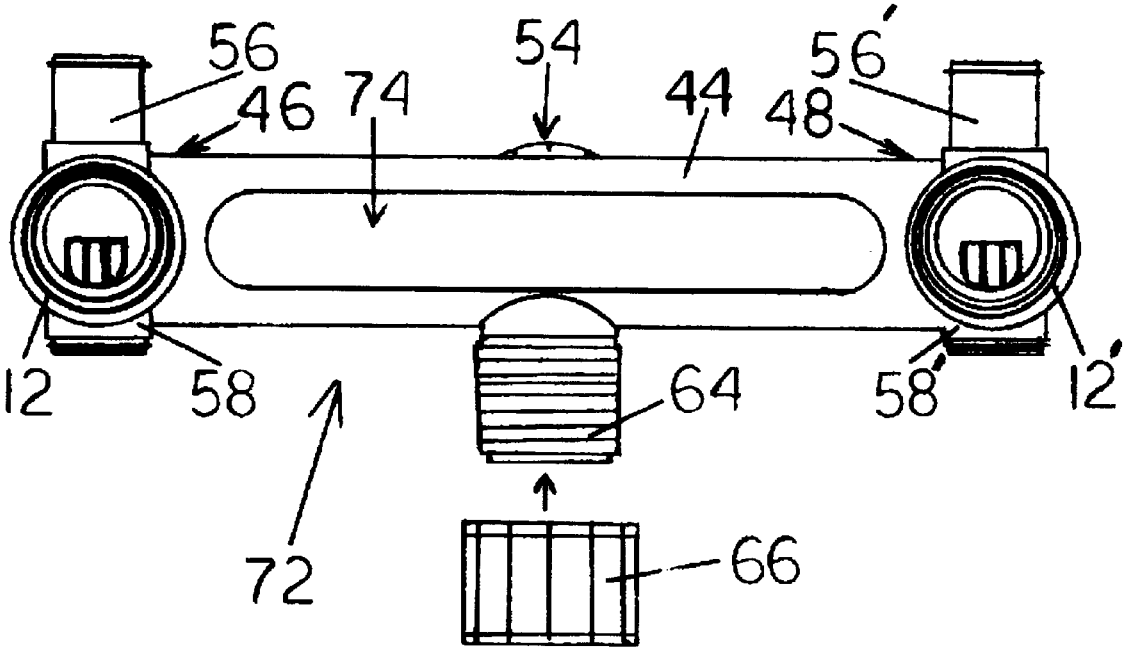
FIG. 15 is a bottom view of the second embodiment of the smaller water delivery member having barrel valves each with a push-button control for selective water cut-off and shown in an opened configuration, a third male connection with a threaded cap, and a flattened lower surface.
Figure 16:
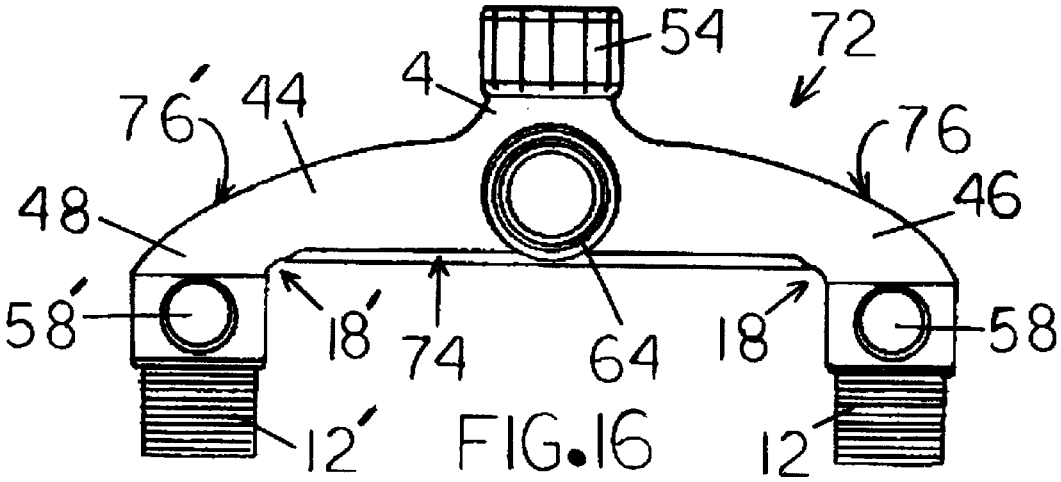
FIG. 16 is a back view of the second embodiment of the smaller water delivery member having a threaded swivel adaptor attached to the outflow connector, barrel valves, a third male connection, and a flattened lower surface.
Figure 17:
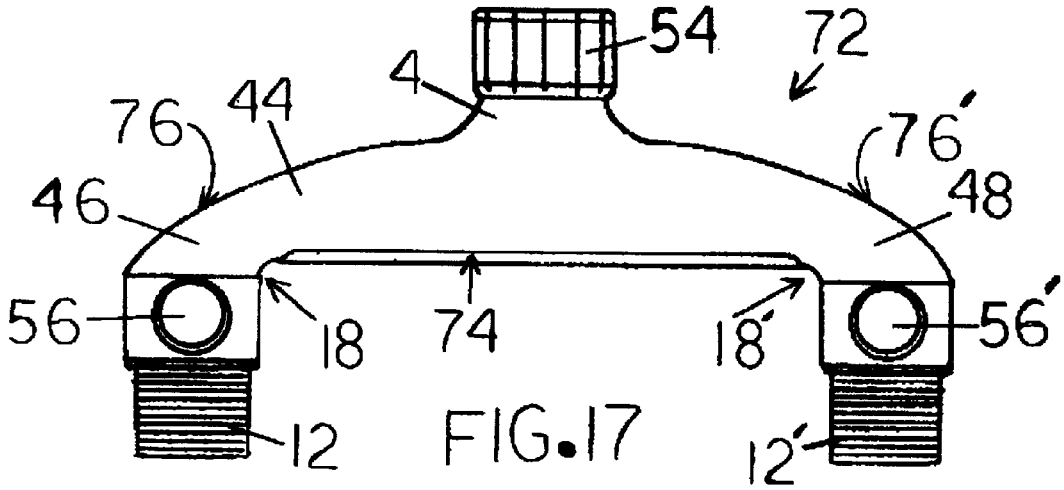
FIG. 17 is a front view of the second embodiment of the smaller water delivery member having a threaded swivel adaptor attached to the outflow connector, push-button controls for selective water cut-off, and a flattened lower surface.
Figure 18:
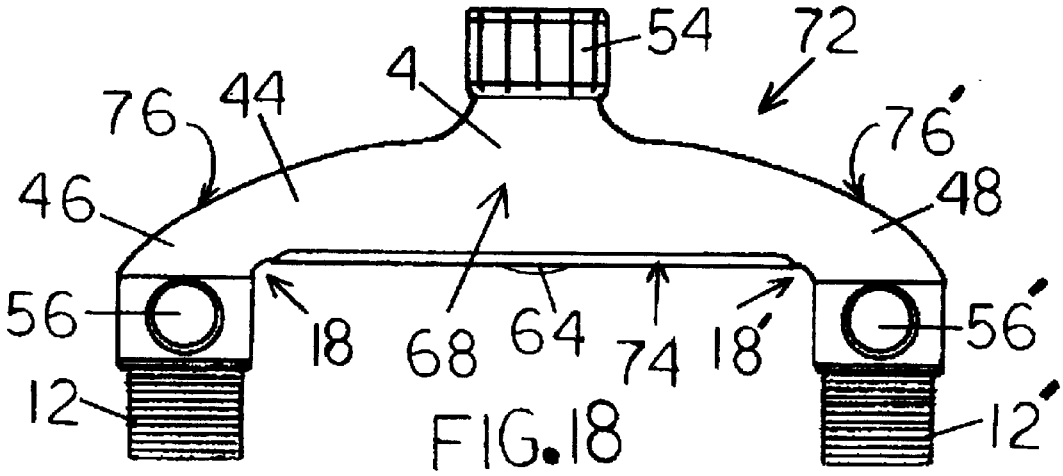
FIG. 18 is a front view of the second embodiment of the smaller water delivery member having a threaded swivel adaptor attached to the outflow connector, the outflow connector having an aesthetically pleasing artistic design, push-button controls for selective water cut-off, a third male connection, and a flattened lower surface.

FIGS. 8–11 show a second embodiment of the elongated larger water delivery member of the present invention referenced by the number 70 and having a threaded swivel adaptor 54 attached to its outflow connector 4. FIGS. 8–11 also show the second embodiment of larger water delivery member 70 having two showerhead attachment arms 10 and 16. FIGS. 8–9 and 11 show each arm 10 and 16 with a distal end having an externally threaded male connection, numbered 12' and 12, respectively. Distal ends 12' and 12 are approximately parallel to one another. Arms 10 and 16 are separated by first and second cross members, numbered 8 and 14 respectively. Each has a flattened upper surface, as denoted by the numbers 62' and 62, respectively in FIGS. 8 and 10. Although FIG. 8 shows first cross member 8 being slightly longer than second cross member 14, the relative length of each is not critical as long as showerheads attached to arms 10 and 16 will not come into contact with a shower stall ceiling 50 during attachment or removal of outflow connector 4 from shower water outflow pipe 24, shown in FIGS. 2 and 3. FIGS. 8 and 9 show the angle 18' between arm 10 and adjacent first cross member 8 being approximately 90° and permitting water flowing into arm 10 to be diverted at an approximate 90° angle relative to first cross member 8. The angle 20 between cross members 8 and 14, shown in FIGS. 8 and 9, is approximately 145° to provide shower stall ceiling 50 clearance during installation and removal. The angle 18 between arm 16 and adjacent cross member 14, also shown in FIGS. 8 and 9, is slightly larger than 90° and of a dimension that permits water flowing into arm 16 to be diverted at an approximate 90° angle relative to first cross member 8. Closer to arm 10 and connected through the surface of cross member 8 in an opposed position from arm 10, FIGS. 8–10 show a short outflow connector 4 adapted for connection through the use of threaded swivel adapter 54 to external threads (not shown) on water delivery pipe 24. In addition, FIGS. 8–9 and 11 show a flattened lower surface 60 extending across first cross member 8 and second cross member 14. Although not critical for such use, informational or design markings (not shown) could be attached to or formed into flattened lower surface 60. FIGS. 8 and 10 show a flattened upper surface, numbered 62' and 62 respectively, on first cross member 8 and second cross member 14. Flattened upper surfaces 62' and 62 can help to form an overall aesthetically pleasing for the present invention, or in the alternative could be used for the addition of informational or design markings (not shown). FIGS. 9–11 show barrel valves 58' and 58 being attached through each showerhead attachment arm, 10 and 16 respectively, while FIGS. 8–11 show the push-button controls 56 and 56' contemplated for selective water cut-off in the second embodiment of the larger water delivery member 70. In addition, FIGS. 9–11 show barrel valves 58' and 58 in opened positions. Further, as shown in FIG. 9 and later in FIGS. 12, 13, and 18, an aesthetically pleasing transition 68 is positioned between first cross member 8 and outflow connector 4.

FIGS. 12–18 show a second embodiment of the smaller water delivery member of the present invention identified by the number 72 and having a threaded swivel adaptor 54 attached to its outflow connector 4. FIGS. 12–14 and 16–18 show the second embodiment of smaller water delivery member 72 having two approximately parallel showerhead attachment arms 48 and 46. FIGS. 12–13 and 16–18 further show arms 48 and 46 each having a distal end with an externally threaded male connection, numbered 12' and 12 respectively. Arms 48 and 46 are separated by a single cross member 44. The angle 18' between arm 48 and cross member 44, shown in FIGS. 12–13 and 16–18, is approximately 90°. The angle 18 between arm 46 and cross member 44, also shown in FIGS. 12–13 and 16–18, has a similar dimension of approximately 90°. Centrally between arm 48 and arm 46, and connected with an aestemetically pleasing transition 68 through the surface of cross member 44 in an opposed position from arms 48 and 46, FIGS. 12–14 and 16–18 show a short outflow connector 4 adapted for connection through the use of threaded swivel adapter 54 to water delivery pipe 24. In addition, FIGS. 13 and 15–18 show a flattened lower surface 74 extending across single cross member 44. Although such use is not critical, informational or design markings (not shown) could be attached to or formed into flattened lower surface 74. FIGS. 12, 14, and 16–18 show a flattened upper surface, numbered 76' and 76 respectively, on opposing ends of single cross member 44. Flattened upper surfaces 76' and 76 can help to form an overall aesthetically pleasing for the present invention, or in the alternative could be used for the addition of informational or design markings (not shown). The second preferred embodiment of shorter water delivery member 72 also has a third male-threaded showerhead connection 64, as shown in FIGS. 12–16 and 18. Although connection 64 could be used for attachment of any type of showerhead, in the second preferred embodiment, although not shown, it is contemplated for a hand-held showerhead to be optionally attached to each connection 64, such as hand-held showerhead unit 28*b* in FIG. 3. When hand-held showerhead unit 28*b* is not needed or wanted for use, FIGS. 12–15 show a female-threaded cap 66 contemplated for watertight attachment to connection 64 in place of hand-held showerhead unit 28*b*. Arrows in FIGS. 12–15 show cap 66 poised for attachment to showerhead connection 64. FIGS. 12–16 show barrel valves 58' and 58 being attached through showerhead attachment arms 48 and 46, respectively, while FIGS. 12–15 and 17–18 show the push-button controls 56' and 56 contemplated for selective water cut-off in the second embodiment of the smaller water delivery member 72. In addition, FIGS. 12–15 show barrel valves 58 and 58' in opened positions.

To use the present invention, larger water delivery members 2 and 70, can be used alone or in combination with smaller water delivery members 42 and 72 to convert water delivery pipe 24 into a water delivery means having two, three, four, five, or six showerheads 28*a–d* attached thereto. Any type of showerhead 28*a–d* can be attached to threaded male connections 12, including hand-held showerheads 28*b* shown in FIG. 3 connected to flexible tubing 40. Also, both larger water delivery members 2 and 70, as well as smaller water delivery members 42 and 72, can have shut-off valves 26*a–b* or barrel valves 58 or 58'. Although larger water delivery members 2 and 70, as well as smaller water delivery members 42 and 72, can each be made from assembled components, in the first and second preferred embodiments both larger water delivery members 2 and 70, as well as smaller water delivery members 42 and 72, are made as a one-piece unit with smooth transitions. Also, in the first and second preferred embodiments it is contemplated for cross member 44 to be approximately three inches in length. Further, it is contemplated for the smaller water delivery members to be dimensioned to allow water flow at a rate that would permit the use of four showerheads at a minimum water flow rate of four gallons per minute. Hazardous materials applications are particularly suitable to the present invention. Due to the unique configuration of the present invention, if made available to firemen to rinse off their clothing and gear after a fire, the water delivery system of the present invention would provide rinsing of the men and gear both faster and more effectively than with other shower systems. Also, the present invention has an advantage of two people (not shown) of like or unlike stature being able to shower in the same stall with adequate water directed on each.

What is claimed is:

1. A method of water delivery for showering purposes that allows water delivered from one positive pressure water outflow pipe to alternatively be divided into two, three, and four water streams, said method comprising the steps of:

providing a water delering member including an elongated larger water delivery member having two approximately parallel male-threaded showerhead attachment arms, a first cross member, a second cross member, an obtuse angle between said first cross member and said second cross member, each of said attachment arms each being positioned at an approximate 90° angle relative to said first cross member, and a female-threaded outflow connector in fluid communication with said first cross member as well as two shorter water delivery members each having two approximately parallel male-threaded showerhead connection arms with a single cross member connected therebetween, in addition to a female-threaded extended outflow connector having an extended female thread pattern adapted for 90° of rotation relative to a positive pressure water outflow pipe without fluid leakage and being in fluid communication with said single cross member; also providing a plurality of showerheads each having a capability for 360° of rotation; and a positive pressure water outflow pipe;

when two water streams are desired connecting said outflow connector of one of said water delivery members to said positive pressure water outflow pipe, and connecting one of said shower heads to each of said showerhead attachment arms on said water delivery member;

when three water delivering streams are desired in the alternate connecting said outflow connector of said larger water delivery member to said positive pressure water outflow pipe, connecting one of said shorter water delivery members to one of said showerhead attachment arms on said larger water delivery member, and further connecting one of said shower heads to the remaining one of said showerhead attachment arms on said larger water delivery member and each of said showerhead attachment arms on said shorter water delivery member; and when four water delivering streams are desired in the alternate connecting said outflow connector of said larger water delivery member to said positive pressure water outflow pipe, connecting one of said shorter water delivery members to each of said showerhead attachment arms on said larger water delivery member, and further connecting one of said shower heads to each of said showerhead attachment arms on said shorter water delivery member so that said larger water delivery member and said smaller water delivery members are used alone and in combination to divide a water stream flowing from said positive pressure water outflow pipe alternatively into two, three, and four water streams for enhanced showering capability and versatility.

2. The method of claim 1 wherein said step of providing said shower heads further comprises the step of providing at least one showerhead with a hand-held configuration and the step of providing at least one showerhead with a water cutoff valve.

3. The method of claim 2 further comprising the step of providing a plurality of threaded swivel adaptors, the step of connecting one of said threaded swivel adaptors to said outflow connector of said larger water delivery member, and the step of connecting one of said threaded swivel adaptors to said extended outflow connectors of each of said shorter water delivery members; wherein said step of providing each said water cut-off valve further comprises the step of providing a barrel valve; wherein said step of providing said shorter water delivery members further comprises the step providing shorter water delivery members each having a male-threaded third showerhead connection with a removable female-threaded cap, and further comprising the step of removing at least one of said female-threaded caps to attach one of said showerheads with a hand-held configuration so that when two of said shorter water delivery members with a male-threaded third showerhead connection are connected to said larger water delivery member, water delivered from one positive pressure water outflow pipe may be additionally divided into five or six water streams.

4. The method of claim 1 wherein said step of providing said obtuse angle further comprises the step of providing an obtuse angle of approximately 145°, the step of providing said single cross member further comprises the step of providing a single cross member having a length dimension of approximately three inches, and said step of providing said shorter water delivery members further comprises the step providing shorter water delivery members each having a minimum water flow capacity of approximately four gallons per minute.

5. A water delivery system for showering purposes that allows water delivered from one positive pressure water outflow pipe to alternatively be divided into two, three, and four water streams, said system comprising:

an elongated larger water delivery member having two approximately parallel showerhead attachment arms, said attachment arms each having a distal end, said distal ends both extending in substantially the same direction and each arm having a plurality of male threads adapted for showerhead attachment, said larger water delivery member also having a first cross member with an outside surface, said first cross member being in fluid communication with one of said attachment arms, a second cross member in fluid communication with the other of said attachment arms, and an obtuse angle between said first cross member and said second cross member, said second cross member also being in fluid communication with said first cross member, said attachment arms each being positioned at an approximate 90° angle relative to said first cross member, said larger water delivery member further having an outflow connector in fluid communication with said first cross member, said outflow connector having a distal end and a plurality of female threads on said distal end adapted for positive flow water outflow pipe attachment, said outflow connector and one of said attachment arms in fluid communication with said first cross member each depending from said outside surface in substantially opposite directions from one another;

two shorter water delivery members each having two approximately parallel showerhead connection arms with two approximately 90° angles between said connection arms, said connection arms each having a distal end, said distal ends both extending in substantially the same direction and each connection arm having a plurality of male threads adapted for showerhead attachment, said shorter water delivery members each also having a single cross member with an outside surface, said single cross member being in fluid communication with both of said connection arms, said shorter water delivery members each further having an extended outflow connector in fluid communication with said single cross member, said extended outflow connector having an extended distal end and a plurality of female threads on said extended distal end adapted for positive flow water outflow pipe attachment as well as approximately 90° of rotation without fluid leakage, said female threads of said shorter water delivery members also each being adapted for connection to said distal ends of said larger water delivery member, said extended outflow connector depending from said outside surface of said single cross member in a direction substantially opposite to said connection arms; and a plurality of showerheads each having a capability for 360° of rotation and being adapted for water-tight connection to said distal ends of said attachment arms and said connection arms so that when said larger water delivery member and said shorter water delivery member are used individually and in combination with one another and said showerheads, and are connected to a positive pressure water outflow pipe, a broader distribution of water is provided for more thorough rinsing capability in a shorter period of time than can be accomplished with water delivered from a single one of said showerheads attached to the same positive pressure water outflow pipe.

6. The system of claim 5 wherein at least one of said showerheads further comprises a water cutoff valve.

7. The system of claim 6 wherein said water cutoff valve is a barrel valve, said obtuse angle is approximately 145°, said single cross member is approximately three inches in length, and said shorter delivery members are each adapted for a minimum water flow of approximately four gallons per minute.

8. The system of claim 5 further comprising at least one threaded swivel adaptor adapted for attachment to said outflow connector of said larger water delivery member and said extended outflow connectors of said shorter water delivery members.

9. The system of claim 5 wherein said larger water delivery member, said shorter water delivery members, and said showerheads are selected from a group of larger water delivery members, shorter water delivery members, and showerheads made from materials consisting of PVC, ABS plastic, stainless steel, copper, brass with chrome-plating, gold plating, colored material, textured materials, and material having surface designs.

10. The system of claim 5 wherein at least one of said showerheads has a hand-held configuration.

11. The system of claim 5 wherein said larger water delivery member and said shorter delivery members are selected from a group consisting of larger water delivery members and shorter water delivery members made from assembled components, and larger water delivery members and shorter water delivery members made as one-piece units with smooth transitions.

12. The system of claim 5 wherein at least one of said shorter delivery members further comprises a male-threaded third showerhead connection, said third showerhead connection depending centrally from said single cross member at approximately 90° relative to said extended outflow connector, said system also further comprising a female-threaded cap adapted for attachment to said third showerhead connection so that when two of said shorter water delivery members are connected to said larger water delivery member water delivered from one positive pressure water outflow pipe may be additionally divided into five or six water streams.

13. A water delivery system for showering purposes that allows water delivered from one positive pressure water outflow pipe in a shower stall with a ceiling to alternatively be divided into two, three, and four water streams, said system comprising:

an elongated larger water delivery member having two approximately parallel showerhead attachment arms, said attachment arms each having a distal end, said distal ends both extending in substantially the same direction and each arm having a plurality of male threads adapted for showerhead attachment, said larger water delivery member also having a short cross member with an outside surface, said short cross member being in fluid communication with one of said arms, a long cross member in fluid communication with the other of said arms, and an obtuse angle between said short cross member and said long cross member adapted for ceiling clearance of said distal ends when said larger water delivery member is rotated for installation and removal from a raised positive pressure water outflow pipe intended for showerhead connection, said short cross member also being in fluid communication with said long cross member, said attachment arms each being positioned at an approximate 90° angle relative to said long cross member, said larger water delivery member further having an outflow connector in fluid communication with said short cross member, said outflow connector having a distal end and a plurality of female threads on said distal end adapted for positive flow water outflow pipe attachment, said outflow connector and one of said attachment arms in fluid communication with said short cross member each depending from said outside surface in substantially opposite directions from one another;

two shorter water delivery members each having two approximately parallel showerhead connection arms with two approximately 90° angles between said connection arms, said connection arms each having a distal end, said distal ends both extending in substantially the same direction and each connection arm having a plurality of male threads adapted for showerhead attachment, said shorter water delivery members also each having a single cross member with an outside surface, said single cross member being in fluid communication with both of said connection arms, said shorter water delivery members each further having an extended outflow connector in fluid communication with said single cross member, said extended outflow connector having an extended distal end and a plurality of female threads on said extended distal end adapted for positive flow water outflow pipe attachment as well as approximately 90° of rotation without fluid leakage, said female threads on each of said shorter water delivery members also being adapted for connection to said distal ends of said larger water delivery member, said extended outflow connector depending centrally from said outside surface of said single cross member in a direction substantially opposite to said connection arms; and a plurality of showerheads each having a capability for 360° of rotation and being adapted for water-tight connection to said distal ends of said attachment arms and said connection arms so that when said larger water delivery member and said shorter water delivery member are used individually and in combination with one another and said showerheads, and are connected to a positive pressure water outflow pipe, a broader distribution of water is provided for more thorough rinsing capability in a shorter period of time than can be accomplished with water delivered from a single one of said showerheads attached to the same positive pressure water outflow pipe.

14. The system of claim 13 wherein at least one of said showerheads further comprises a water cutoff valve.

15. The system of claim 14 wherein water cutoff valve is a barrel valve, said obtuse angle is approximately 145°, said single cross member is approximately three inches in length, and said shorter delivery members are each adapted for a minimum water flow of approximately four gallons per minute.

16. The system of claim 13 further comprising at least one threaded swivel adaptor adapted for attachment to said outflow connector of said larger water delivery member and said extended outflow connectors of said shorter water delivery members.

17. The system of claim 13 wherein said larger water delivery member, said shorter delivery members, and said showerheads are selected from a group of larger water delivery members, shorter water delivery members, and showerheads made from materials consisting of PVC, ABS plastic, stainless steel, copper, brass with chrome-plating, gold plating, colored material, textured materials, and material having surface designs.

18. The system of claim 13 wherein at least one of said showerheads has a hand-held configuration.

19. The system of claim 13 wherein said larger water delivery member and said shorter delivery members are selected from a group consisting of larger water delivery members and shorter water delivery members made from assembled components, and larger water delivery members and shorter water delivery members made as one-piece units with smooth transitions.

20. The system of claim 13 wherein at least one of said shorter delivery members further comprises a male-threaded third showerhead connection, said third showerhead connection depending centrally from said single cross member at approximately 90° relative to said extended outflow connector, said system also further comprising a female-threaded cap adapted for attachment to said third showerhead connection so that when two of said shorter water delivery members are connected to said larger water delivery member water delivered from one positive pressure water outflow pipe may be additionally divided into five or six water streams.

* * * * *